United States Patent [19]

Laesser et al.

[11] 4,367,049

[45] Jan. 4, 1983

[54] DRIVING DEVICE ESPECIALLY FOR A TIMEPIECE

[75] Inventors: Claude Laesser, La Chaux-de-Fonds; Gérard Piller; Jean Depery, both of Neuchâtel, all of Switzerland

[73] Assignee: Ebauches S.A., Neuchatel, Switzerland

[21] Appl. No.: 938,522

[22] Filed: Aug. 31, 1978

[30] Foreign Application Priority Data

Sep. 2, 1977 [CH] Switzerland ..... 10768/77
Jun. 20, 1978 [CH] Switzerland ..... 6672/78

[51] Int. Cl.³ ..... G04B 19/00
[52] U.S. Cl. ..... 368/76; 368/184
[58] Field of Search ..... 310/40 R, 40 MM, 49 R; 318/696; 58/23 R, 23 D, 85.5

[56] References Cited

U.S. PATENT DOCUMENTS 2,867,762 1/1959 Lehman et al. ..... 310/49 R X
3,671,841 6/1972 Hoffmann ..... 310/49 R X
3,818,690 6/1974 Schwarzschild ..... 58/23 D
4,055,785 10/1977 Nakajima et al. ..... 310/49 R X
4,066,947 1/1977 Nakajima et al. ..... 310/49 R X
4,092,820 6/1978 Kume et al. ..... 58/23 D X
4,112,671 9/1978 Kato et al. ..... 58/23 D
4,150,536 4/1979 Nakajima et al. ..... 58/23 D

*Primary Examiner*—Ulysses Weldon
*Attorney, Agent, or Firm*—Silverman, Cass & Singer, Ltd.

[57] ABSTRACT

Driving device especially for a timepiece, constituted by a stepping motor the stator of which comprises a coil having a single winding and the rotor of which is constituted of a permanent magnet and of a control electronic circuit able to deliver pulses of current to the motor. The motor includes precise positioning magnets for its rotor which are active in the absence of the pulses. The electronic control circuit is arranged in such a way that the pulses are delivered in pairs, with opposed polarities in each pair, the order of succession of the polarities in a pair determining the sense of rotation of the rotor.

10 Claims, 22 Drawing Figures

DRIVING DEVICE ESPECIALLY FOR A TIMEPIECE

BACKGROUND OF THE INVENTION

The present invention relates to a driving device, especially for a timepiece. The invention includes a step-by-step or stepping motor comprising a stator and a rotor. The stator comprises a coil having only one winding arranged around a core which constitutes or establishes a magnetic circuit, the core having a yoke surrounding a free space, and the free space having substantially the shape of a cylinder of revolution. The rotor is constituted by a permanent magnet having at least one pair of magnetic poles diametrically opposed and is rotatably mounted in the free space. The invention further includes means for controlling the motor able to deliver to the coil pulses of current.

This driving device is mainly intended to drive, through the intermediary of a gearing, the hands of an electronic watch having an analog display.

In most electromechanical watches which are presently known, one uses a stepping motor receiving driving pulses at a fixed and precise frequency. The pulses are produced from a control circuit driven by a quartz oscillator followed by a frequency divider. The motor is arranged in such a way as to be able to rotate only in one sense or direction corresponding, obviously, to the normal sense or clockwise rotation of the hands of the watch.

There are, however, some cases where a motor able to rotate in two senses, clockwise and counterclockwise, is suitable, especially when one desires to provide the watch with a system of correction, automatic or not, of its time cations, or with a system permitting to pass from one time-zone to another without losing the exact time.

Motors able to rotate clockwise and counterclockwise have been developed, as well as suitable control circuits.

Some of these motors are provided with two windings into which the control circuit send pulses of current, the pulses being alternated according to a determined order which determines the sense of rotation.

Other motors are provided with only one winding, into which the control circuit sends alternating pulses of current. When the rotor is in one of its positions of balance, there being two such positions of balance which are determined, for instance, by the shape of the stator, a pulse in one sense or a first polarity, arbitrarily designated as being of positive polarity, produces a rotation of the rotor a half a revolution in the clockwise direction for instance. The rotor then reaches its other position of balance, in which to produce a new rotation of half a revolution in the clockwise direction, it is necessary to send a pulse of an opposite sense or polarity, designated as being of negative polarity. From the first position of balance, a negative polarity pulse produces a rotation of the rotor a half a revolution in the counterclockwise direction, rotation which can be continued from the other position of balance by the sending of a positive polarity pulse.

This arrangement or device shows or exhibits the drawback that, if after a shock for instance, the rotor of the motor has made an untimely half a revolution, or has not reacted to the sending of a driving pulse, its sense or direction of rotation is reversed, even when not desired, since the succeeding pulses continue in the pre-determined order, but the position of the rotor is not what it should be.

The positions of balance of the rotor are generally determined by an asymetric shape which is given to or formed in the stator of the motor. This asymetry produces a difference in the driving torque according to the direction of rotation. That is a drawback, since it produces a reduction in the efficiency of the motor which is very disagreeable in an electronic watch where the consumption must be as low as possible.

On the other hand, in most of the electronic watches having an analog display which are presently known, a stepping motor is used which receives pairs of pulses of current at a fixed and precise frequency, as already mentioned. At the end of each of these pairs of pulses, or when the motor is at rest, one takes the necessary steps, presently, so that the coil of the stator of the motor be is short-circuited by the of control circuit of the motor so as to obtain a substantial braking of the rotor, so that the rotor will be rapidly immobilized at the end of a step. This braking is obtained by an action of the induced current circulating in the coil immediately after the end of the pulses of current.

One knows also the control device of a stepping motor rotating clockwise and counterclockwise, each step being 180°, such as is disclosed in U.S. Pat. No. 4,066,947. This control device is also arranged in such a way as to short-circuit the coil of the motor when there is no pulse of current.

The drawback of these arrangements is due to the fact that a non-negligible part of the electric energy transmitted to the motor is absorbed uselessly by the damping of the movement of the rotor when there is no pulse of current.

The purpose of the present invention is to remove the mentioned drawbacks.

This purpose is reached owing to the means as claimed.

BRIEF DESCRIPTION OF THE DRAWING

The drawing shows, by way of example, several embodiments of the object of the invention.

DESCRIPTION OF THE PREFERRED EMBODIMENT

Figure 1:
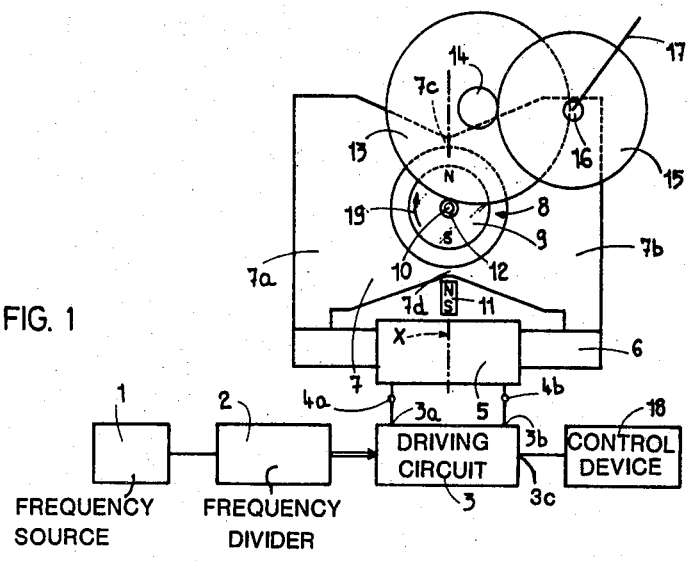
FIG. 1 is a diagrammatic view of a driving device comprising a stepping motor applied to a watch.

The watch as represented diagrammatically in FIG. 1 comprises a basis of time or frequency source 1 consisting of, for instance, a quartz oscillator which delivers a signal having a frequency of 32 kHz to a frequency divider 2 formed in a way known per se of several stages of division arranged in series. The signals delivered by at least one of the stages of division are applied to a driving circuit 3 the outputs 3*a* and 3*b* of which are connected to the terminals 4*a* and 4*b* of a motor 4. Motor 4 comprises a single winding 5 connected to the terminals 4*a* and 4*b*, wound around a core or member 6 made of soft magnetic material. Member 6 is prolongated by an armature stator 7, also made of soft magnetic material, constituted by two relatively massive parts or yokes 7*a* and 7*b* connected between each other by thinner portions 7*c* and 7*d*, providing a central free space 8 having the shape of a cylinder of revolution.

A rotor 9 made of a permanent magnet having a diametrical magnetization is located in the free space 8 so as to be able to rotate around a shaft 10 the axis of which coincides with the axis of the free space 8.

A second permanent magnet 11, constituted by a magnetized bar, is mounted beside or above the thin portion 7*d* of the stator 7, so that its plane of magnetization North-South passes through the axis of the rotor 9. The dimensions and the magnetic characteristics of the stator 7, especially those of the thin portions 7*c* and 7*d* and of the magnet 11 are choosen so that the fields of the magnets 9 and 11 cooperate for positioning the rotor. When no current is passing through the coil 5, the dashed and dotted line X defined by the pair of the poles or rotor 9 passes through the two poles of the magnet 11.

The rotor 9 carries a pinion 12 which constitutes the first element of a gearing comprising moreover a movable element 13-14 and a wheel 15. On the shaft 16 of wheel 15 is mounted a hand 17 representing diagrammatically, alone, all the display elements of the watch.

The watch comprises moreover a control device 18 of the direction of rotation of the motor, examples of which will be disclosed in more detail hereafter.

Figure 2A:
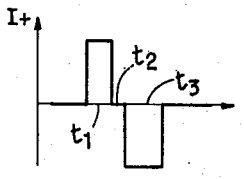
FIGS. 2*a* and 2*b* show the pulses delivered to the motor, portions a and b corresponding respectively to the positive or clockwise and negative or counterclockwise rotation of the motor.
Figure 2B:
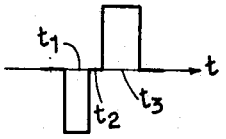
Figure 3:
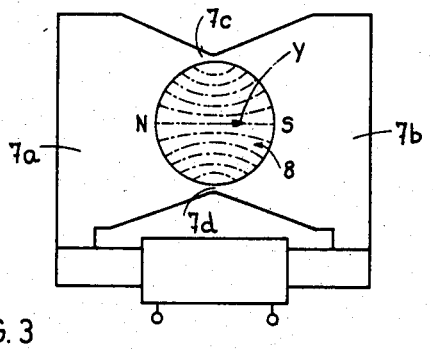
FIG. 3 shows, diagrammatically, the magnetic field produced in the yoke of the motor by the positive driving pulses.

The pulses delivered to the motor 4 by the driving circuit 3 are represented in FIGS. 2*a* and 2*b* in which it has been choosen arbitrarily, that the clockwise rotation is that rotation resulting from the pulses producing in the stator 7 a field such that the yoke 7*a* acts as a North magnetic pole and the yoke 7*b* as a South magnetic pole. This field, which is much more intense than that due to the positioning magnet 11, has been represented in FIG. 3 where dashed and dotted lines indicate diagrammatically the distribution of the field showing the lines of force in the free space 8 when the rotor 9 and the positioning magnet 11 are not in place. These lines of force have a main direction indicated by the arrow Y. For a negative pulse, the direction of the magnetic field created is, obviously, reversed.

Figure 4:
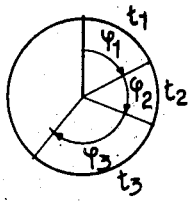
FIG. 4 shows diagrammatically the angles on which the rotor has rotated during the driving pulses.

Consequently, the magnetic field created by a positive pulse (FIG. 2*a*) urges the rotor to rotate from its position of balance a quarter of a revolution in the direction indicated by the arrow 19 (FIG. 1), i.e. clockwise. This pulse is cut after a time t1, when the rotor has rotated an angle $\phi 1$ (FIG. 4). During the time t2, the rotor continues its movement owing to its kinetic energy and runs on to an angle $\phi 2$. At the end of the time t2, the rotor has been driven of an angle of more than 90°, which has the effect that a field created by the negative pulse which the driving circuit starts to deliver at this time urges the rotor to continue to rotate clockwise. The duration of this pulse is t3 and, when it ends, the rotor has rotated an angle $\phi 3$. The sum of the angles $\phi 1$, $\phi 2$ and $\phi 3$ being greater than 180°, the rotor is then brought to its starting position, owing to its kinetic energy and to the positioning torque resulting from the interaction of the magnet 11 and the rotor 9. Consequently the rotor has effected a complete clockwise revolution under the influence of one pair of driving pulses formed of a positive pulse followed by a negative pulse.

For rotating the rotor in the opposite direction, it is sufficient to deliver first a negative pulse, as indicated in FIG. 2*b*, followed by a positive pulse. The magnetic fields created by these pulses bring the rotor to rotate counterclockwise.

The durations t1, t2 and t3 of the pulses and of the time which separates them depend from the characteristics of the motor and from the torque it has to furnish or provide. The times t1 and t3 can be equal or different; it can be especially interesting to have $t3 > t1$ for taking into account the increase of the antagonist torque created by the repulsion of the North poles of the magnets 9 and 11 when the rotor terminates its first half revolution.

The same way, depending from the cases, one can cancel the time of duration t2 between the two driving pulses.

Figure 5:
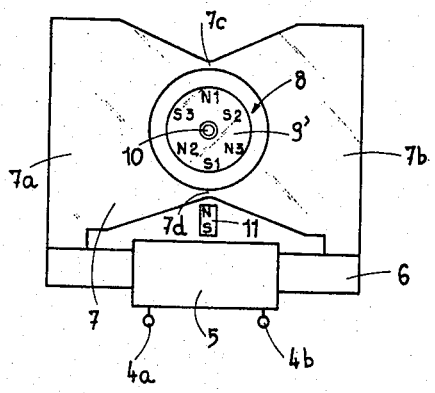
FIG. 5 shows a motor provided with a rotor having three pairs of poles.

It is moreover possible to provide the rotor with more than one pair of magnetic poles, provided however that this number be uneven. FIG. 5 shows a motor the rotor 9′ of which, mounted in a stator 7 similar to that of FIG. 1, has three pairs of poles designated by N1-S1, N2-S2 and N3-S3. It is easy to ascertain that each pair of pulses similar to those of FIG. 2*a* produces the rotation of the rotor of a third of a counterclockwise revolution, while each pair of pulses similar to these of FIG. 2*b* produces a rotation of one third of a clockwise revolution. A rotor with five pairs of poles on the other side, would rotate in the same way as that of FIG. 1. It is obvious that the duration of the driving pulses must be adapted to the number of the poles of the rotor.

Figure 6:
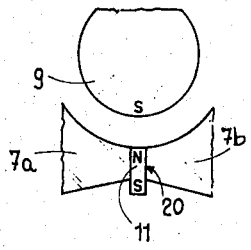
FIGS. 6 to 10 show details of modifications of stepping motors.

FIGS. 6 to 10 show several modifications of the motor:

In the modification of FIG. 6, the two yokes 7*a* and 7*b* of the stator 7, which are represented, are separated from each other by a slit 20 in which is arranged the positioning magnet 11.

Figure 7:
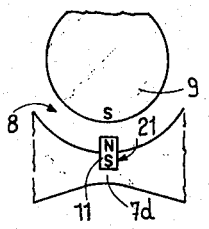

In FIG. 7, the positioning magnet 11 is located in a notch 21, between the thinner portion 7*d* of the stator and the free space 8.

Figure 8:
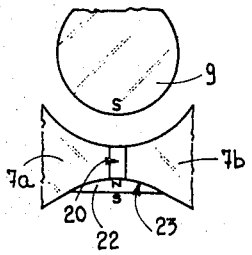

In FIG. 8, as in FIG. 6, the yokes 7*a* and 7*b* of the stator 7 are separated from each other by a slit 20, but the positioning magnet, having the shape of a segment of circle 22, is located in a round portion 23 of the stator.

Figure 9:
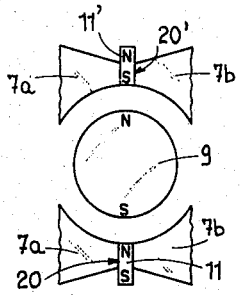

In FIG. 9, a positioning magnet 11 is located in a slit 20, as in the modification of FIG. 6, but its effect is reinforced by a second positioning magnet, designated by 11', situated in a slit 20', on the other side of the rotor 9.

The slits 20 and 20' respectively, which, in the case of the embodiment of FIGS. 5, 7 and 8, are provided in the portions *7d* and *7c* of the stator 7, have the effect of creating a supplementary positioning torque of the rotor; this torque, which is sinusoidal with a period of half a revolution of the rotor, ensures a more regular distribution, is one revolution, of the driving torque.

Figure 10:
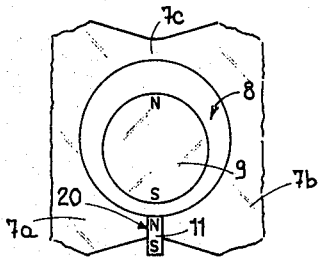

A similar effect is reached by a decentering of the rotor such as is represented in FIG. 10, the effect which is combined, in this case, with the slit 20.

Other arrangements can still be provided for the mounting of the positioning magnet, and other means can be used for influencing the variation of the driving torque or of the positioning torque in function of the angle of rotation of the rotor, without leaving from the scope of the invention.

Figure 11:
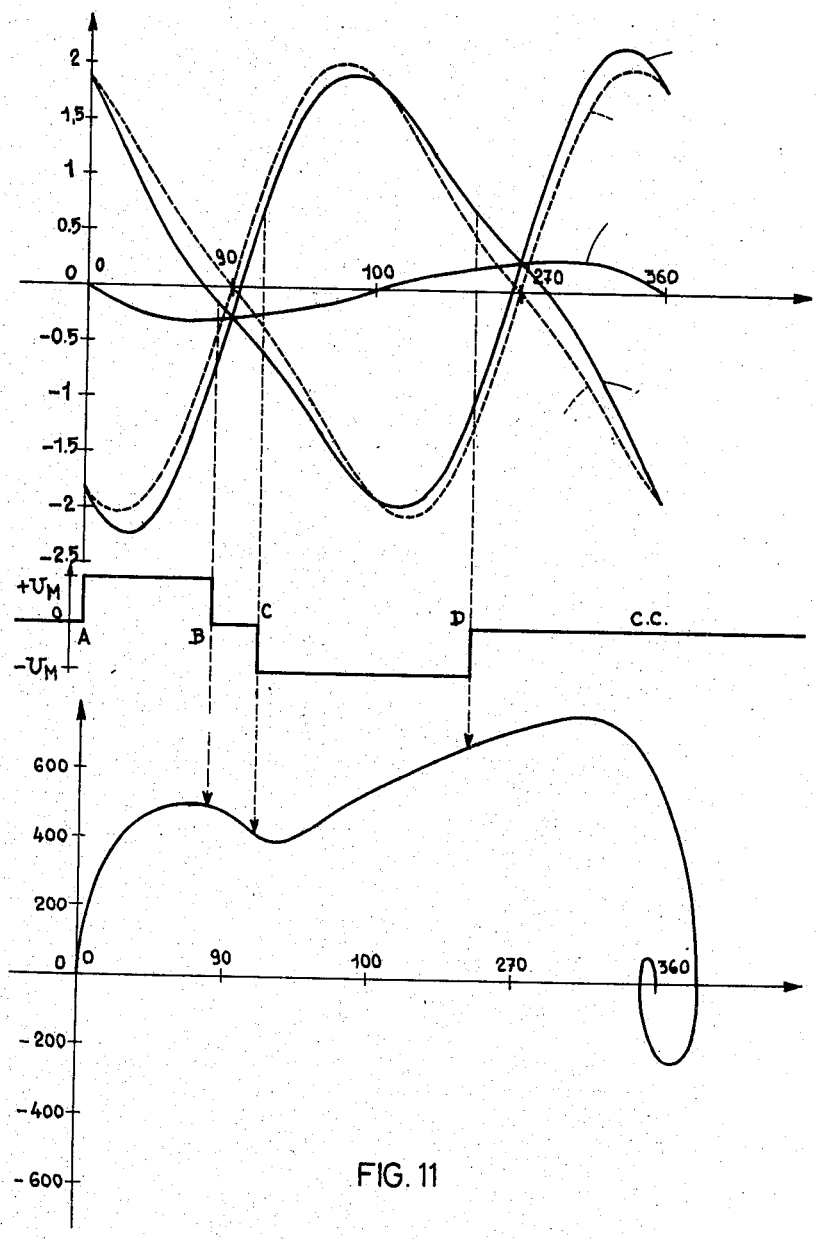
FIG. 11 is a diagram of a known mode of operation of the driving device represented in FIG. 1.

FIG. 11 is a diagram of the driving torque of the device of FIG. 1, the voltage $U_m$ at the terminals of the coil 5 and the angular speed of the rotor 9 of the motor 4 as a function of its angular rotation. This figure shows that the positive pulse of voltage $+U_m$ produces a driving troque which rotates the rotor 9 (in the sense of the arrow 19) from the rest position A to the position B. After a time of rest where the coil 5 of the motor is no longer fed, but during which the rotor continues to rotate up to the position C, the coil receives at its terminals a negative pulse $-U_m$ rotating the rotor from the position C to the position D. From the position D, the coil 5 of the motor is short circuited for braking the movement of the rotor the speed of which increases still up to a position situated at about 300°. The speed of the rotor than decreases rapidly up to the end of the step (360°).

Figure 12:
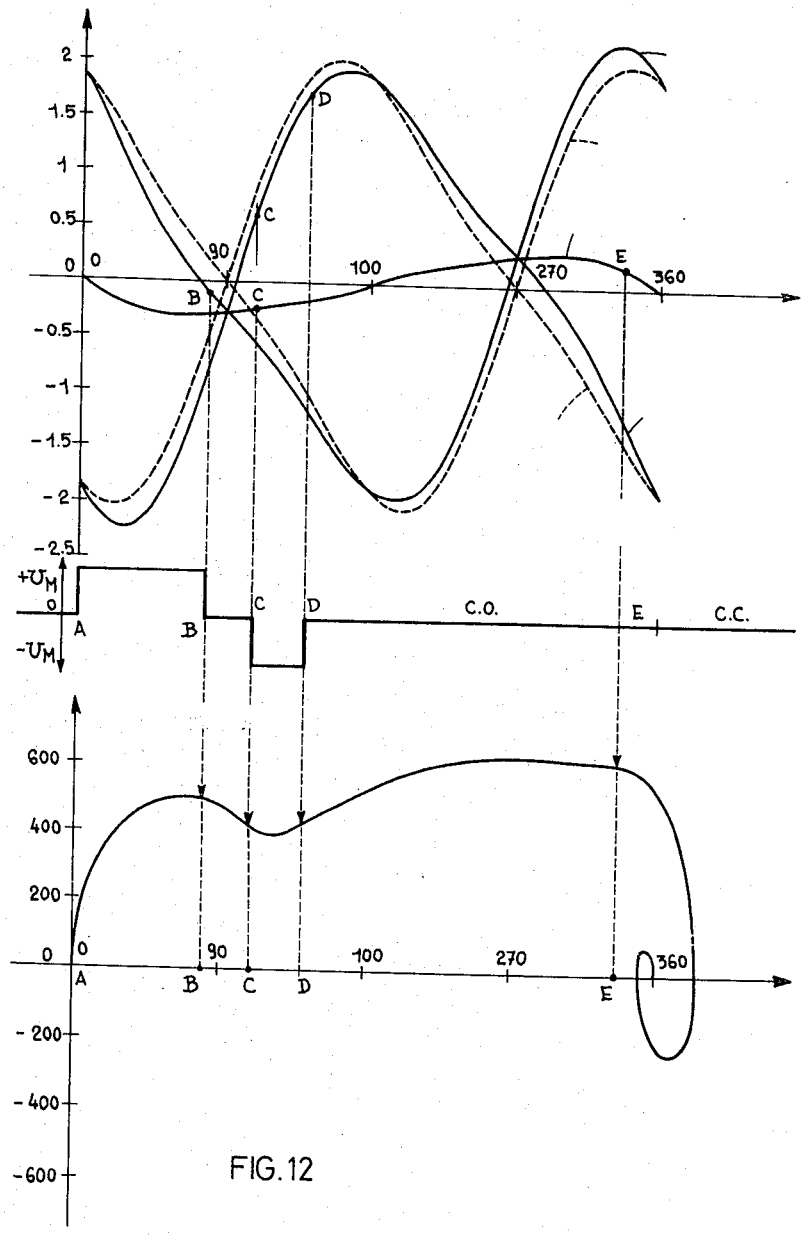
FIG. 12 is a diagram showing the mode of operation according to the invention of the driving device represented in FIG. 1.

The diagram represented in FIG. 12 illustrates the operation of the motor of the device of FIG. 1, used in a device according to the invention. This diagram represents the driving torque, the voltage in the terminals of the coil 5 and the angular speed of the rotor 9 as function of the angle of rotation.

Up to the position C of the rotor, everything is similar to the diagram of FIG. 11. At point C, the coil 5 of the motor receives at its terminals a negative pulse $-U_m$ of a duration much shorter (C-D) than in the case illustrated in FIG. 11.

From the position D, the driving circuit which is disclosed later is arranged in such a way as to present a resistance which is practically infinite to the coil 5, so that this coil 5 is in an open circuit. A damping of the speed of the rotor 9 taking no longer place, the movement of this rotor is braked or slowed only by the resistance due to the gearing driving the display elements.

It is then sufficient to produce the braking of the movement of the rotor in the vicinity of the position of the end of a step, that is to say the position E, so that the rotor stops after a damped oscillation in the position at the end of a step.

It can be noted on the diagram of the angular speed as a function of the angle of rotation (lower portion of FIG. 12) that the maximum speed reached is lower than in the case of the known device such as represented in FIG. 1 and the diagram of which is represented in FIG. 11, due to the fact that the braking of the rotor produced by the counter-electromotive force of a short circuit in the coil of the rotor does not any longer exist, it is no longer necessary to start the rotor at a high speed in order to surmount this force. One saves in this manner an appreciable quantity of energy for rotating the motor.

Figure 13:
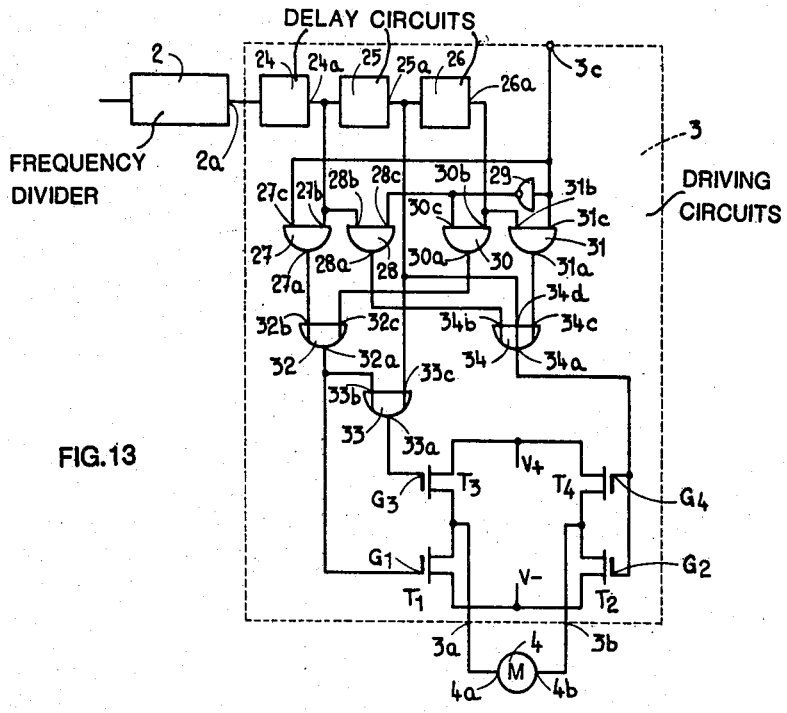
FIG. 13 is an example of driving circuit of the motor represented in FIG. 3.
Figures 14A, 14B:
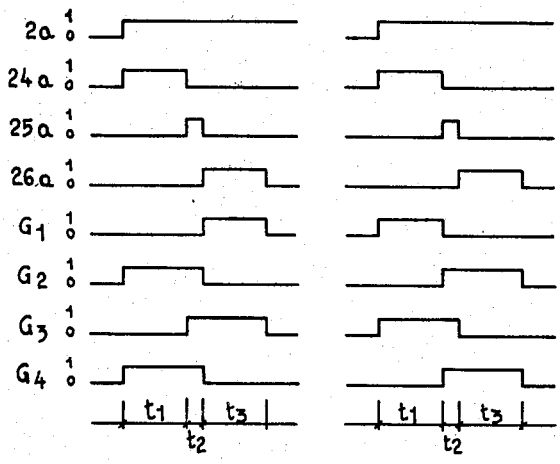
FIGS. 14*a* and 14*b* illustrate the way the control electrodes or gates of the transistors of the circuit of FIG. 13 must be controlled so that the pulses represented in FIG. 2 are delivered to the stepping motor, the portion a corresponding to the or clockwise rotation of the motor and the portion b to the counterclockwise rotation.

FIG. 13 shows an example of a driving circuit 3 comprising, among other elements, four MOS transistors T1, T2, T3 and T4 having their sources connected in pairs to a negative pole V− of a power supply for the transistors T1 and T2, which are of N type, and to a positive pole V+ of the power supply for the transistors T3 and T4 which are of P type. The drains of the transistors T1 and T3 are connected to each other and to the terminal **4*a* of the motor 4 by the intermediary of the output 3*a* of the driving circuit 3. The drains of the transistors T2 and T4 are also connected to each other and to the terminal 4*b* of the motor, by the intermediary of the output 3*b* of the circuit 3**.

It is to be remembered that a 0 logic level applied to the control electrode or gate of an MOS transistor produces its locking or non-conduction if it is an N type transistor and its conduction if it is a P type transistor while the opposite effects are obtained by a "1" logic level.

So that these four transistors deliver to the motor 4 the pulses disclosed previously and illustrated in FIG. 2, it is necessary that their gates G1 to G4 be controlled in the way illustrated in FIG. 12. At the rest state of the motor, between the driving pulses, the coil 5 of the motor must be short circuited, which is obtained in this example by applying a "0" logic level to the gates of the four transistors, which in turn renders the transistors T1 and T2 non-conductive and renders the transistors T3 and T4 conductive.

For rotating the motor clockwise (FIG. **14*a*) one renders the transistor T4 non-conductive and one renders the transistor T2 conductive by applying a "1" logic level to their gates G4 and G2 during the time t1**.

During the time t2, one cuts the current without short circuiting the coil 5, in order to prevent the damping of the movement of the rotor, by rendering the transistor T3 non-conductive by application of a "1" logic level to its gate G3.

During the time t3, one renders the transistor T2 non-conductive and the transistors T1 and T4 conductive by applying a "0" logic level on the gates G2 and G4 of the transistors T2 and T4 and a "1" logic level on gate G1, of the transistor T1.

At the end of time t3, one cuts the current in the coil 5 by rendering the transistor T1 non-conductive and one short circuits coil 5, for damping the rotation of the rotor, by rendering the transistor conductive. This state, which is the rest state of the motor, is reached by applying a "0" logic level to the gates G1 and G3 of these two transistors.

For bringing the motor to rotate counterclockwise (FIG. **14*b*), one inverts the logic levels for rendering the transistors non-conductive and conductive during the times t1 and t3**.

One ascertains that the gates G2 and G4 of the transistors T2 and T4 must always be in the same state; consequently, they can be connected to each other and be controlled together.

A circuit capable of delivering the signals disclosed hereabove is also represented in FIG. 13. The circuit is composed of three monostable or one shot temporizers or delay circuits 24, 25 and 26 connected in series and arranged in such a way as to deliver at their outputs 24*a*, 25*a* and 26*a*, respectively, positive pulses having durations equal to t1, t2 and t3. The delay circuit 24 starts to deliver its pulse when the output 2*a* of the divider 2 to which its input is connected, passes from the "0" logic level to the "1" logic level. The two other circuits 25 and 26 deliver their output when their inputs passes from the "1" logic level to the "0" logic level.

The output 24*a* of the delay circuit 24 is connected to the inputs 27*b* and 28*b* of two AND gates 27 and 28 the second inputs of which 27*c* and 28*c* respectively, are connected to the input 3*c* of the driving circuit 3, either directly, or through the intermediary of an inverter 29.

The same way, the output 26*a* of the delay circuit 26 is connected to the inputs 30*b* and 31*b* of two AND gates 30 and 31 the second inputs of which, 30*c* and 31*c*, are connected to the input 3*c* of the circuit 3, either through the intermediary of the inverter 29, or directly.

The outputs 27*a* and 30*a* of the gates 27 and 30 are connected to the inputs 32*b* and 32*c* of an OR gate 32, the outputs 32*a* of which is connected to the gate G1 of the transistor T1 as well as to the input 33*b* of an OR gate 33. The second input of gate 33, 33*c*, is connected to the output 25*a* of the delay circuit 25, and the output 33*a* is connected to the gate of the transistor T3.

The outputs 28*a* and 31*a* of the gates 28 and 31 are connected to the inputs 34*b* and 34*c* of an OR gate 34 a third input of which, 34*d*, is connected to the output 25*a* of the delay circuit 25 and the output 34*a* of which is connected to the gates G2 and G4 of the transistors T2 and T4.

If the input 3*c* of the driving circuit 3 is at the "0" logic level, the gates G2 and G4 of the transistors T2 and T4 are put to the "1" logic level, during the time t1, through the intermediary of the gates 28 and 34. During the time t2, this "1" logic level is maintained on these gates G2 and G4 by the intermediary of the gate 34 and is applied to the gate G3 of the transistor T3 by the gate 33. During the time t3, the gates G1 and G3 of the transistors T1 and T3 receive a "1" logic level by the intermediary of the gates 30 and 32, and gates 30, 32 and 33 respectively.

If the input 3*c* is at the "1" logic level, the "1" logic level which is present at the output 24*a* of the delay circuit 24 during the time t1 is applied to the gates G1 and G3 of the transistors T1 and T3 by the intermediary of the gates 27, 32 and 33. During the time t2, the gates G2, G3 and G4 of the transistors T2, T3 and T4 receive the "1" logic level, which is present at the output 25*a* of the delay circuit 25, by the intermediary of the gates 33 and 34. During the time t3, at last, the gates G2 and G4 of the transistors T2 and T4 receive a "1" logic level from the output 26*a* of the delay circuit 26, by the intermediary of the gates 31 and 34.

In an electronic watch, it is obviously suitable to realize the function of the delay circuits by means of logic and digital circuits using signals delivered by the intermediary stages of the frequency divider 2.

Moreover it is also advantageous to save a portion of the braking energy of the rotor, due to the fact that the coil is short circuited, in the absence of pulses of current, by a circuit as this illustrated in FIG. 13.

Figure 15:
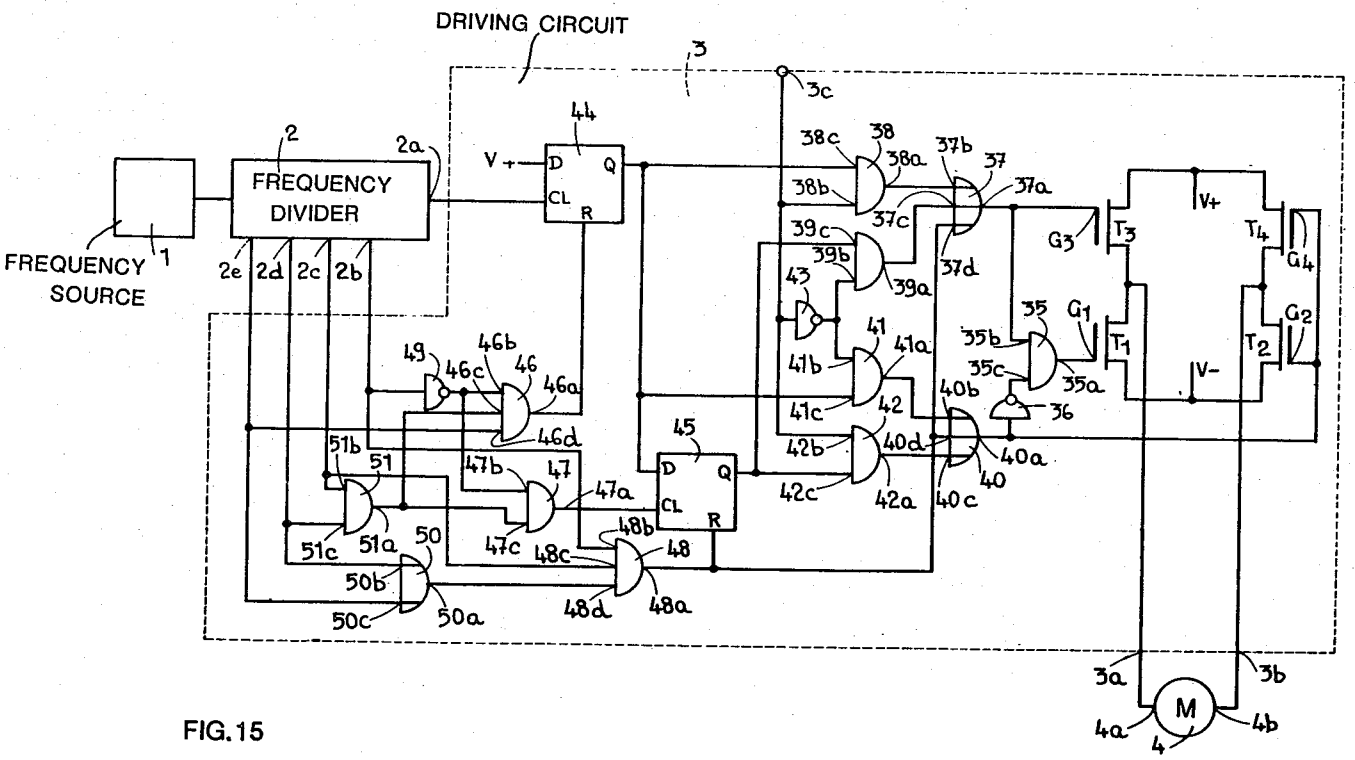
FIG. 15 is an example of a driving circuit for the motor represented in FIG. 1.

FIG. 15 gives an example of a driving circuit 3 intended to drive a motor of the type of device illustrated in FIG. 1. This circuit 3 comprises among other elements, four MOS transistors T1, T2, T3 and T4. Transistors T1 and T2 are N type and have their sources connected in pairs to the negative pole V− of the power supply. Transistors T3 and T4 are P type and have their sources connected to the positive pole V+ of the power supply. The drains of the transistors T1 and T3 are connected to each other and to the terminal 4*a* of the motor 4 by the intermediary of the output 3*a* of the driving circuit 3. The drains of the transistors T2 and T4 are connected to each other and to the terminal 4*b* of the motor by the intermediary of the output 3*b* of the circuit 3.

Figures 16A, 16B:
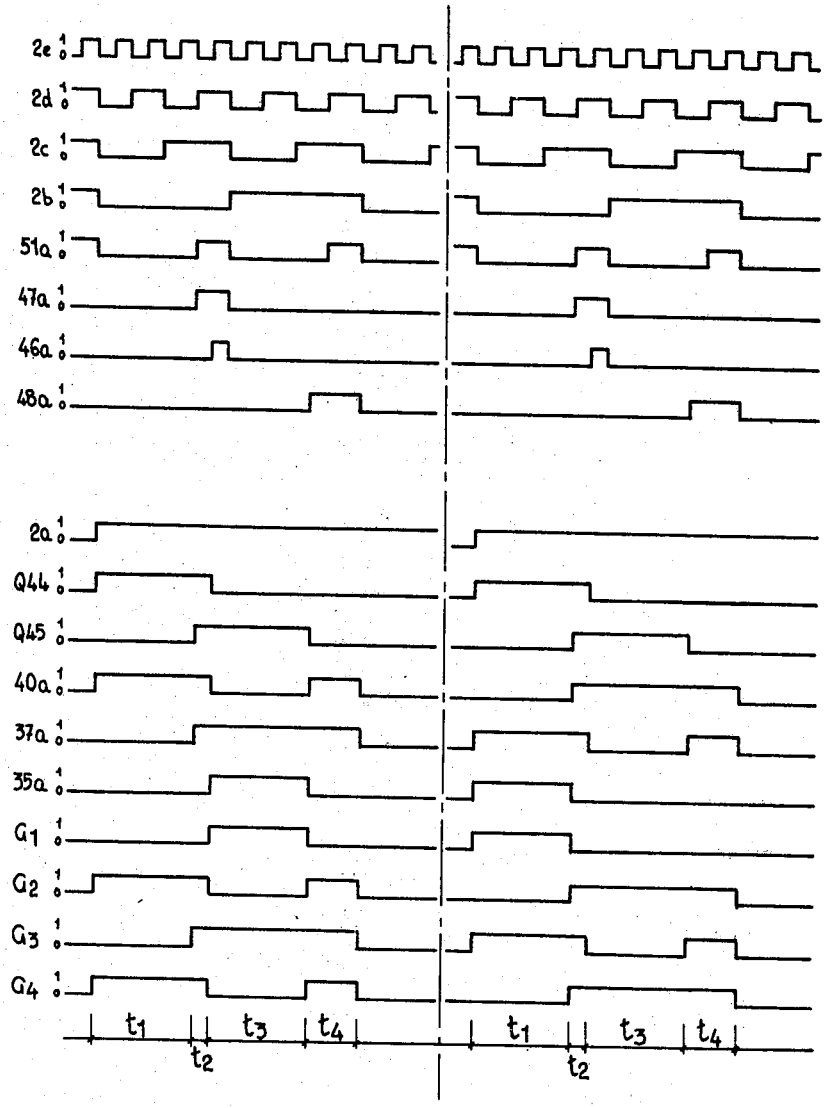
FIGS. 16*a* and 16*b* show the logic states or levels of several elements of the circuit of FIG. 15, portions a and b corresponding respectively to the clockwise and counterclockwise rotation of the motor.

So that these four transistors deliver to the motor 4 the pulses which have been previously disclosed and illustrated in FIG. 12, it is necessary that their gates G1 to G4 be controlled in the way illustrated in FIGS. 16*a* and 16*b*. At the rest state of the motor, between the driving periods, the coil 5 of the motor must be short circuited, which is obtained, in this example, by applying a "0" logic level to the gates of these four transistors, which renders the transistors T1 and T2 non-conductive and renders the transistors T3 and T4 conductive.

For bringing the motor to rotate clockwise (FIG. 16*a*), the transistor T4 is rendered non-conductive and the transistor T2 is rendered conductive by applying a "1" logic level to the gates G4 and G2 during the time t1.

During the time t2, one cuts the current without short circuiting the coil 5, for preventing the damping of the movement of the rotor, while rendering the transistor T3 non-conductive by application of a "1" logic level to its gate G3.

During the time t3, the transistor T2 is rendered non-conductive the transistors T1 and T4 are rendered conductive by applying a "0" logic level to the gates G2 and G4 of the transistors T2 and T4 and a "1" logic level to the gate, G1, of the transistor T1.

During the time t4, the current is again cut without short circuiting the coil 5 for cancelling the braking of the movement of the rotor as it has already been disclosed, while rendering the transistors T1 and T4 non-conductive by application of a "0" logic level to the gate G1 of the transistor T1 and a "1" logic level to the gates G2, G3 and G4.

At the end of the time t4, the coil 5 is short circuited by rendering T3 and T4 conductive for damping the rotation of the motor and one renders the transistor T2 non-conductive. This state, which is the rest state of the motor, is reached by applying a "0" logic level to the gates G1, G2, G3 and G4 of these transistors.

For bringing the motor to rotate counter clockwise (FIG. 16*b*), one inverts the logic levels rendering the transistors non-conductive and conductive during the times t1 and t3.

One ascertains that the gates G2 and G4 of the transistors T2 and T4 must always be in the same state. Consequently they can be connected to each other and can be controlled at the same time.

A circuit able to deliver the signals as disclosed hereabove is also represented, as an example of application, in FIG. 15. It is provided for driving a motor which must receive pulses where the times t1 through t4 are respectively of about 6, 1, 6 and 3 milliseconds.

The gate G1 of the transistor T1 is connected to the output 35*a* of an AND gate 35 the inputs 35*b* and 35*c* of which are connected, respectively, to the gate G3 of the transistor T3 and, by the intermediary of an inverter 36, to the gates G2 and G4 of the transistors T2 and T4 which are connected to each other.

The gate G3 is moreover connected to the output 37*a* of an OR gate 37 the inputs 37*b* and 37*c* of which are connected to the outputs 38*a* and 39*a* of two AND gates 38 and 39, and the input 37*d* of which is connected to the output 48*a* of an AND gate 48. In a similar way, the gates G2 and G4 are connected to the output 40*a* of an OR gate 40 the inputs 40*b* and 40*c* of which are connected to the outputs 41*a* and 42*a* of two AND gates 41 and 42 and the input of which, 40*d*, is connected to the output 48*a* of the gate 48.

The input 3*c* of the driving circuit 3, serving to determine the direction of rotation of the motor 4, is connected directly to the inputs 38*b* and 42*b* of the gates 38 and 42 and, by the intermediary of an inverter 43, to the inputs 39*b* and 41*b* of the gates 39 and 41.

The inputs 38*c* and 41*c* of the gates 38 and 41 are connected to the output Q of a D type flip flop 44, while the inputs 39*c* and 42*c* of the gates 39 and 42 are connected to the output Q of another D type flip flop, designated by 45.

The input D of the flip flop 44 is connected to the positive pole of the power supply V+ which corresponds to the "1" logic level. This way, its output Q will take the "1" logic level at each passage from the "0" logic level to the "1" logic level of its clock input CL, which is connected to the output 2*a* of the divider 2. Its reset to zero input R is connected to the output 46*a* of an AND gate 46.

The input D of the flip flop 45 is connected to the output Q of the flip flop 44, its clock input CL being connected to the output 47*a* of an AND gate 47 and its reset to zero input R being connected to the output 48*a* of the AND gate 48.

The inputs 46*b* and 47*b* are connected to each other and, by the intermediary of an inverter 49, to the output 2*b* of the divider 2, to which is also connected the input 48*b* of the AND gate 48. The inputs 46*c* and 47*c* are both connected to the output 51*a* of an AND gate 51.

The inputs 51*b* and 48*c* are connected to each other and to another intermediary output, designated by 2*c*, of the divider 2, while the input 51*c* of the AND gate 51 and the input 50*b* of an OR gate 50 are both connected to the output 2*d* of the divider 2. The inputs 46*d* and 50*c* are connected to each other and to the output 2*e* of the divider 2. The output 50*a* is connected to the input 48*d*.

The input of the divider of frequency 2 is connected to the output of the quartz oscillator of frequency source 1.

Without going into details of operation of the circuit, which are understandable without difficulty to anybody skilled in the art, one sees, while referring to FIGS. 16*a* and 16*b*, that the output Q of the flip flop 44 passes from the "0" logic level to the "1" logic level at each passage of the output 2*a* of the divider 2 from the "0" logic level to the "1" logic level, that is to say at each second. After three periods of the signal delivered by the output 2*e* of the divider 2, the output 47*a* of the gate 47 delivers a signal which brings the output Q of the flip flop 45 to pass to the "1" logic level. After another half a period of the signal 2*e*, the output 46*a* of the gate 46 passes in its turn to the "1" logic level which produces the return of the output Q of the flip flop 44 to the "0" logic level. After a time equal again to three periods of the signal 2*e*, the output 48*a* of the gate 48 passes to the "1" logic level which produces the passage of the output Q of the flip flop 45 to the "0" logic level. After still another time equal to one and half periods of the signal 2*e*, the output 48*a* goes back to the "0" logic level.

The "0" and "1" logic levels of the outputs Q of the flip flops 44 and 45 are transmitted to the gates G1 to G4 of the transistors T1 to T4 by the intermediary of the gates 39 and 41 when the input 3*c* which determines the direction of rotation, is at the "0" logic level, and by the intermediary of the gates 38 and 42 when input 3*c* is at the "1" logic level. The signals measured at the different points of the circuit are represented in FIG. 16*a* in the first case, which corresponds to a clockwise rotation of the motor and in FIG. 16*b* in the second case, which corresponds to a counterclockwise rotation of the motor.

During the time t4, where the circuit of the motor 4 must be open, the "1" logic level of the inputs 37*d* and 40*d* is transmitted to the outputs 37*a* and 40*a* which control the state of the transistors T1 to T4 as already disclosed.

The time t1 of the example disclosed in FIGS. 15 and 16 is represented here by the time where the output Q of the flip flop 44 is the only output at the "1" logic level. The time t2 is represented by the time where both the outputs Q of the two flip flops 44 and 45 are at the "1" logic level. The time t3 is represented by the time where the output Q of the flip flop 45 is the only output at the "1" logic level and the time t4 is represented by the time where both the outputs Q of the two flip flops are at the "0" logic level.

In the example disclosed, the outputs 2*b* through 2*c* of the divider 2 deliver signals having frequencies of, respectively, 64, 128, 256 and 512 Hz. Consequently, the times t1 and t3 are equal to 3″/512, that is to say about 6 ms, the time t2 is equal to 0.5″/512, that is to say about 1 ms, and the time t4 is equal to 1.5″/512, that is to say about 3 ms, values which correspond to the desired values.

The length of these times could, obviously, be modified by changing the circuit constituted by the gates and inverters 46 to 51, so as to obtain control signals of the flip flops 44 and 45 at different moments.

Figure 17:
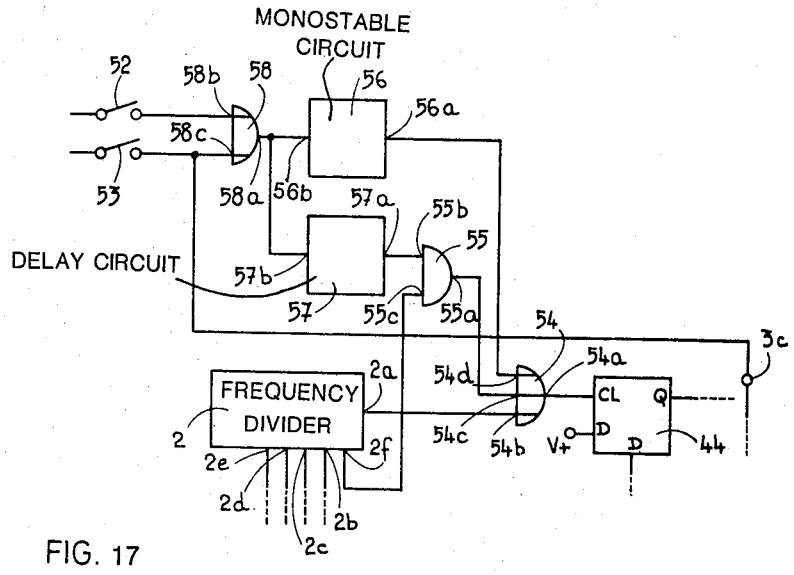
FIGS. 17, 18 and 19 show three modifications of circuits of electronic watches in which the motor represented in FIG. 1 can be used.
Figure 18:
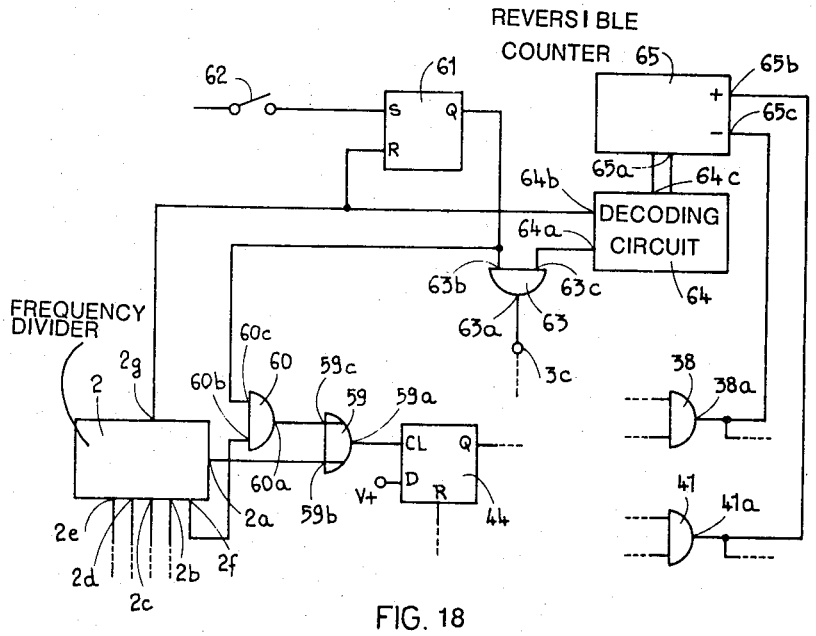
Figure 19:
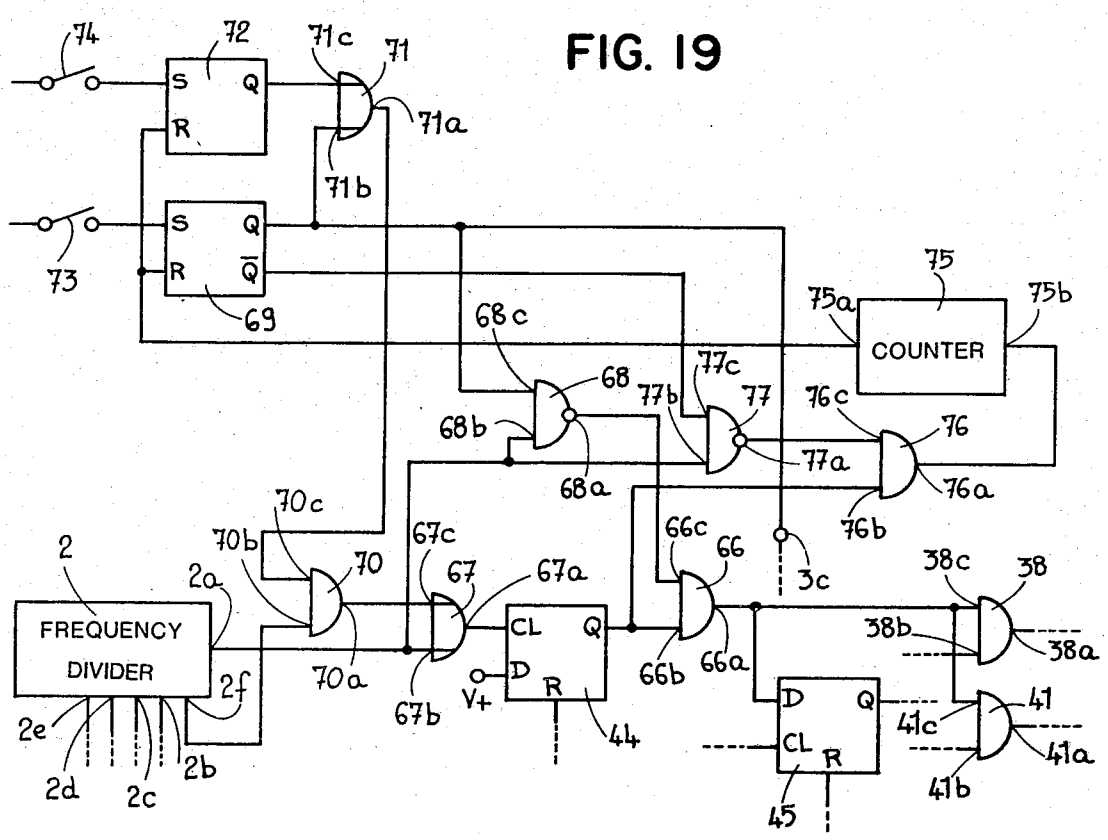

The driving device hereabove disclosed can be used in watches provided with several control circuits such as these which are illustrated in FIGS. 17, 18 and 19.

The circuit the diagram of principle of which is given in FIG. 17 enables the user to correct the state of his watch very easily. This watch is provided with two push-buttons, not illustrated, which close contacts 52 and 53, respectively, when they are operated.

The driving circuit is identical to that designated by 3 and represented in FIG. 15, with the exception of the connection between the output 2*a* of the divider 2 and the input CL of the flip flop 44. This connection is made by the intermediary of an OR gate 54 the output 54*a* of which is connected to the input CL of the flip flop 44, and an input 54*b* of which is connected to the output 2*a* of the divider 2. The second and third inputs 54*c* and 54*d* of this gate 54 are connected, respectively, to the output 55*a* of an AND gate 55, and to the output 56*a* of a monostable circuit 56.

The inputs 55*b* and 55*c* of the gate 55 are connected, respectively, to the output 57*a* of a temporizer or delay circuit 57 and to an intermediary output 2*f* of the divider 2 which delivers, for instance, a signal at a frequency of 32 Hz.

The monostable circuit 56 and the delay circuit 57 have their inputs 56*b* and 57*b* connected together and to the output 58*a* of an OR gate 58 the inputs 58*b* and 58*c* of which are connected, by the intermediary of adaptation circuits which have not been represented, to the contacts 52 and 53.

The input 58*c* of the gate 58 is moreover connected to the input 3*c* of the driving circuit 3. The rest of the driving circuit has not been drawn since it is identical to that of FIG. 15.

The contacts 52 and 53, as well as the adaptation circuits, are arranged in such a way that, when the contacts are open, a "0" logic level is applied to the inputs 58*b* and 58*c* of the gate 58 and that, when the user pushes on one of the push-buttons for closing one of the contacts, a "1" logic level appears on the corresponding input.

The monostable circuit 56 delivers at its output 56*a* a unique or single pulse each time its input 56*b* passes from the "0" logic level to the "1" logic level. The delay circuit 57, on its side, delivers at its output 57*a* a "1" logic level some time after its input 57*b* has passed from the "0" logic level to the "1" logic level, provided it has remained thereon without interruption. This output "1" logic level disappears as soon as the input 57*b* passes back to the "0" logic level.

When the user desires to advance his watch one second, for instance, he presses shortly on the push-button corresponding to the contact 52. The monostable circuit 56 delivers then a pulse which reaches the flip flop 44 by the gate 54 and which produces the formation, in the driving circuit, of a pair of driving pulses, as it has been disclosed hereabove.

If he desires to retard his watch one second, he presses shortly on the push-button corresponding to the contact 53. This also produces the formation of a pair of driving pulses, but this applies, at the same time, a "1" logic level on the input 3*c* of the driving circuit, which corresponds to a counterclockwise rotation of the motor.

If the user wants to correct the state in his watch of a more important or greater quantity, he presses for a longer time on the desired push-button. The first pair of driving pulses is produced as it has been disclosed hereabove, but, when the output 57*a* of the delay circuit 57 passes to the "1" logic level, the gate 55 allows the pulses delivered by the output 2*f* of the divider 2 to pass therethrough. The driving circuit 3 starts then to deliver to the motor pairs of driving pulses at a frequency of 32 Hz, as long as the user pushes on the push-button. The direction of rotation is obviously determined by the push-button which is operated.

The circuit the diagram of principle of which is given in FIG. 18 allows an almost automatic correction of the state of the watch.

As in the case of FIG. 17, the input CL of the flip flop 44 is not connected directly to the output 2*a* of the divider 2, but to the output 59*a* of an OR gate 59 the inputs 59*b* and 59*c* of which are connected, respectively, to the output 2*a* of the divider 2, and to the output 60*a* of an AND gate 60. The first input 60*b* of this gate 60 is connected to an intermediary output 2*f* of the divider 2, which delivers a signal having, for instance, a frequency of 32 Hz. The second input, 60*c*, of this gate 60 is connected to the output Q of an R-S type flip flop R-S 61 the input S of which is connected, by the intermediary of an adaptation circuit not represented, to a contact 62. The user can close this contact while acting on a push-button which also has not been represented.

The input 3*c* of the driving circuits is connected to the output 63*a* of an AND gate 63 the inputs 63*b* and 63*c* of which are connected respectively to the output Q of the flip flop 61 and to an output 64*a* of a decoding circuit 64. This decoding circuit is provided with a second output 64*b* which is connected to the input R of the flip flop 61 and to an input 2*g* of the divider 2.

The several inputs 64*c* of the decoder 64 are connected to the several outputs 65*a* of a reversible counter 65 the increment input 65*b* of which is connected to the output 41*a* of the gate 41 and the decrement input 65*c* of which is connected to the output 38*a* of the gate 38 (FIG. 15).

The counter 65 has a storage capacity of 60. The decoding circuit 64, which is associated thereto delivers a "1" logic level at its output 64*b* each time the outputs 65*a* of the counter 65 are in the state corresponding to the decimal data or number O, and delivers a "1" logic level at its output 64*a* so long these outputs 65*a* are in a state corresponding to a decimal number comprised between 0 and 29.

The content of the counter 65 corresponds always to the position of the second hand of the watch. Its increment input 65*b* receives, as a matter of fact, a pulse from the output 41*a* of the gate 41 for each pair of driving pulses which rotate the motor clockwise, and its decrement input 65*c* receives a pulse from the output 38*a* of the gate 38 for each pair of driving pulses rotating the motor counterclockwise. Moreover for ensuring a perfect synchronization even after a change of the battery, means of synchronization, which have not been represented, for instance a contact operated by a cam rigidly connected to the second hand, resets this counter to zero each time the second hand passes the indication of noon or "12" on the dial.

For resetting his watch, the user presses the push-button in coincidence with a time signal transmitted by any means such as radio, TV, etc. which indicates the beginning of a minute. This causes the flip flop 61 to change state, its output Q passing to the "1" logic level.

If, at this time, the counter 65 is in a state corresonding to a decimal number comprised between 0 and 29, it means that the watch is going fast. If, on the other hand, this counter is in a state corresponding to a number comprised between 30 and 59, it means that the watch is going slow, it being admitted or understood that the watch has not been advanced or retarded by more than 30 seconds from the time of the last resetting.

When the output Q of the flip flop 61 is at a "1" logic level, the gate 60 allows the pulses delivered by the output 2*f* of the divider 2 to pass therethrough, these pulses reaching the flip flop 44. The driving circuit 3 delivers, as it has been disclosed hereabove, a pair of driving pulses for each of these pulses. The direction of rotation is determined by the output 63*a* of the gate 63, which passes to the "1" logic level if the watch is going fast—the output 64*a* of the decoding circuit 64 is, as a matter of fact, at the logic level in this case—or which remains at the "0" logic level if the watch is going slow.

The content of the counter 65 remains in concordance with the position of the second hand, and when this hand reaches "12" on the dial, the counter 64 passes to the number zero, and the output 64*b* of the decoding circuit 64 passes to the "1" logic level. This signal resets the flip flop 61 to the "0" logic level, which cuts the transmission by the gate 60 of the pulses from the output 2*f* of the divider 2 and, by the input 2*g* of the divider 2, brings again to the "0" logic level at least a portion of the division stages which constitute the divider 2.

From this time on, the watch is set correctly, and it continues to run normally.

The circuit the diagram of principle of which is given in FIG. 19 permits a correction of the state of the watch when its user passes from one time zone to another, or for passing from daylight savings time in summer to standard time in winter and, reciprocally, without modifying the precision of the display.

One finds again, in this figure, the divider 2, the flip flops 44 and 45 and the gates 38 and 41 of the circuit of FIG. 15. But the inputs CL of the flip flop 45, and 38*c* and 41*c* of the gates 38 and 41, respectively, are not connected directly to the output Q of the flip flop 44; they are connected to the output 66*a* of an AND gate 66 an input 66*b* of which is connected to the output Q of the flip flop 44. The input CL of flip flop 44 is connected to the output 67*a* of an OR gate 67 an input 67*b* of which is connected to the output 2*a* of the divider 2.

The input 66*c* of the gate 66 is connected to the output 68*a* of a NAND gate 68 the inputs 68*b* and 68*c* of which are connected to the output 2*a* of the divider 2, and to the output Q of an R-S flip flop 69, as is the input 3*c* of the driving circuit 3.

The input 67*c* of the gate 67 is connected to the output 70*a* of an AND gate 70 the inputs 70*b* and 70*c* of which are connected respectively to the output 2*f* of the divider 2 and to the output 71*a* of an OR gate 71. The inputs 71*b* and 71*c* of gate 71 are connected respectively to the output Q of the flip flop 69 and to the output Q of another R-S type flip flop 72.

The inputs S of these two flip flops 69 and 72 are connected, by adaptation circuits which have not been represented, to two contacts 73 and 74 which the user can close while pressing on one or the other of two push-buttons provided on his watch and which also have not been represented too. The inputs R of these two flip flops are connected to each other and to the output 75*a* of a counter 75 the input 75*b* of which is connected to the output 76*a* of an AND gate 76. The first input 76*b* of this gate is connected to the output Q of the flip flop 44 and its second input, designated by 76*c*, is connected to the output 77*a* of a NAND gate 77 the inputs 77*b* and 77*c* of which are connected respectively to the output 2*a* of the divider 2 and to the output of the flip flop 69.

The counter 75 has a maximum counting capacity of 3,600. When the user wants to change the time indicated by his watch by one hour, he presses on the push-button corresponding to the contact 74 such as if he is moving towards the east or if he wants to advance his watch by one hour, and on the push-button corresponding to the contact 73 such as if he is moving towards the west or if he wants to retard his watch by one hour. In the first case, the flip flop 72 changes state, and the gate 70 allows the pulses delivered at a frequency of 32 Hz to pass through from the output 2*f* of the divider 2. The input 3*c* of the driving circuit 3 remains at the "0" logic level while the motor is driven clockwise, at 32 steps per second. The pulses appearing at the output Q of the flip flop 44 are transmitted, by the intermediary of the gate 76 the input 76*c* of which is at the "1" level, between the pulses delivered by the output 2*a* of the divider 2, to the input 75*b* of the counter 75 which counts them. When this counter arrives at a 3,600 count, its output 75*a* passes to the "1" logic level which resets the flip flop 72 to zero and cuts the transmission of the pulses from the output 2*f* of the divider 2 to the flip flop 44. However, when the output 2*a* of the divider 2 delivers a pulse, which is a normal pulse for advance the motor, the output 77*a* of the gate 77 passes to the "0" logic level which prevents the counting by the counter 75 of this pulse. This way, at the end of the correction period, the duration of which is longer than one minute, the time indicated by the watch is correct and it has been taken into account the time used for making this correction.

Likewise, when the user has pressed on the push-button corresponding to the contact 73, that causes the flip flop 69 to change state, the gate 70 allowing the pulses delivered by the output 2*f* of the divider 2 to pass to the flip flop 44. Consequently the motor again receives driving pulses, but the input 3*c* of the driving circuit being at the "1" logic level, the motor rotates counterclockwise. The pulses which are present at the output of the flip flop 44 are counted by the counter 75, as hereabove, but the normal advance pulses appearing at the output 2*a* of the divider 2 this time render the gate 66 non-conductive, by the intermediary of gate 68, and do not produce a pair of driving pulses. Hence, in this case too, the time indicated by the watch at the end of the correction period is correct, the time used for making this correction having being taken into account.

The diagrams of FIGS. 17, 18 and 19 as it has been said, are only diagrams of principle. That means that, in reality, they should be completed by elements intended to prevent overlappings of signals, or to synchronize some of these signals one with each other. But these modifications are obvious for anybody skilled in the art and will not be disclosed here.

Likewise, one can propose other diagrams for realizing the functions mentioned hereabove, or use the driving device in other applications, without going beyond the scope of the invention.

What we claim is:

1. A driving device especially for a timepiece, comprising:

a stepping motor including stator means including two yokes and one common coil wrapped around the yokes, the yokes delimiting a substantially cylindrical space therebetween and having end surfaces disposed in facing relationship with respect to each other and defining two zones of high reluctance, a permanent magnet rotor having at least one pair of diametrically opposed magnetic poles, the rotor being rotatably mounted in said cylindrical space, and at least one permanent magnet mounted in the vicinity of one of said zones and having a magnetic field to set the rotor in a rest position in the absence of any magnetic field other than that created by said magnet and said rotor; and application means for applying to said coil one first pulse having a first polarity and a given amplitude followed by one second pulse having a second polarity and said amplitude in response to a control signal of one value to cause said motor to make one step clockwise and for applying one first pulse having said second polarity and said amplitude followed by one second pulse having said first polarity and said amplitude in response to a control signal of another value to cause said motor to make one step counterclockwise.

2. The driving device as claimed in claim 1 in which said application means include means for cutting current applied to the coil at the end of said second pulse for a predetermined time interval and then short circuiting said coil.

3. The driving device as claimed in claim 2 in which said application means include means for cutting current applied to said coil between said first and second pulses.

4. The driving device as claimed in claim 1 in which said first pulse is immediately followed by said second pulse.

5. The driving device as claimed in claim 1 in which said permanent magnet includes one pair of poles and is mounted with the plane of magnetization defined by said pair of poles intersecting the axis of said cylindrical space.

6. The driving device as claimed in claim 5 in which said permanent magnet is mounted on said stator means.

7. The driving device as claimed in claim 5 in which said permanent magnet is mounted in the vicinity of said stator means.

8. The driving device as claimed in claim 1 in which the axis of rotation of said rotor coincides with the axis of said cylindrical space.

9. The driving device as claimed in claim 5 in which the axis of rotation of said rotor intersects said plane of magnetization but does not coincide with the axis of said cylindrical space.

10. A driving device especially for a timepiece, comprising:

a stepping motor including stator means including two yokes and one common coil having two terminals, the coil being wrapped around the yokes, the yokes delimiting a substantially cylindrical space and having end surfaces disposed in facing relationship to each other to define two zones of high reluctance, a permanent magnet rotor having at least one pair of diametrically opposed magnetic poles, the rotor being rotatably mounted in said cylindrical space, and at least one permanent magnet mounted in the vicinity of one of said zones and having a magnetic field to set the rotor in a rest position in the absence of any magnetic field other than that created by said magnet and said rotor;

a power supply with a positive and negative pole;

coupling means for coupling one terminal of the coil to said positive pole and the other terminal to said negative pole to apply a positive pulse to the coil, said one terminal to said negative pole and said other terminal to said positive pole to apply a negative pulse to the coil, said one and other terminals to the same pole to short circuit the coil and only one terminal to one of the positive and negative poles to open the circuit of the coil; and means for controlling said coupling means to apply to said coil one first pulse having a first polarity and a given amplitude followed by one second pulse having a second polarity and said amplitude in response to a control signal of one value to cause said motor to make one step clockwise and to apply to said coil one first pulse having said second polarity and said amplitude followed by one second pulse having said first polarity and said amplitude in response to a control signal of another value to cause said motor to make one step counterclockwise.

* * * * *